United States Patent [19]

Uhlig

[11] 4,126,289

[45] Nov. 21, 1978

[54] MODULAR SUPPORT

[76] Inventor: David B. Uhlig, P.O. Box 99532, Pacific Beach, Calif. 92109

[21] Appl. No.: 804,779

[22] Filed: Jun. 8, 1977

[51] Int. Cl.[2] ..... A47B 3/06

[52] U.S. Cl. ..... 248/188.1; 108/157

[58] Field of Search ..... 248/188.1, 188.6, 159; 108/64, 111, 114, 135, 150, 153, 157; 211/189, 191, 193; D6/177, 178

[56] References Cited

U.S. PATENT DOCUMENTS

| | | | |
|---|---|---|---|
| D. 242,681 | 12/1976 | Thomas | D6/177 |
| 1,306,666 | 6/1919 | Houston | 108/157 |
| 3,731,639 | 5/1973 | Schliemann et al. | 108/157 |

FOREIGN PATENT DOCUMENTS

| | | | |
|---|---|---|---|
| 697,388 | 1/1931 | France | 108/64 |
| 1,024,318 | 3/1953 | France | 108/157 |

*Primary Examiner*—Marion Parsons, Jr.

[57] ABSTRACT

An article of manufacture, such as a table, comprising a base of interengageable modules, each module including two parallel horizontal members forming a slot therebetween and one horizontal member engaged within the slot of an adjacent module, thereby forming a supporting structure for a horizontal surface, such as a table top.

3 Claims, 12 Drawing Figures

Fig. 11
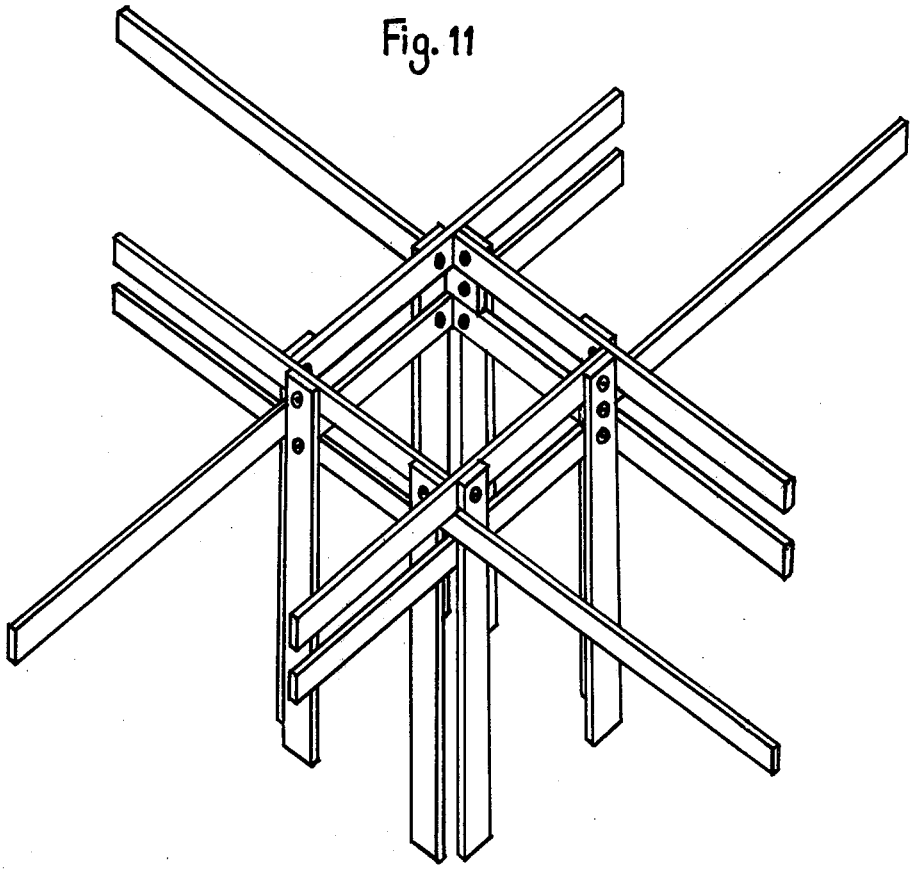
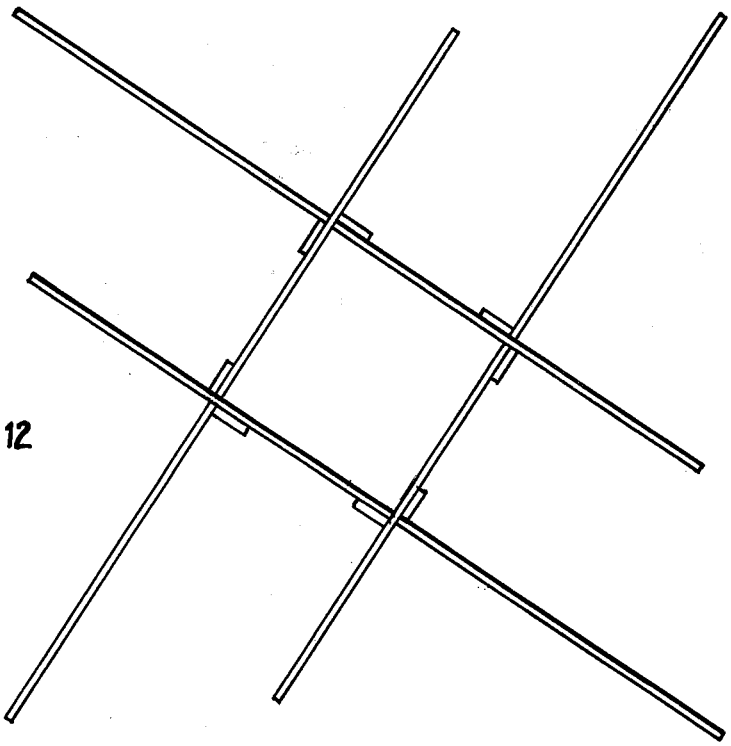
Fig. 12

MODULAR SUPPORT

PRIOR ART

The present invention relates to a table construction wherein the supporting base is formed of interengaging modular units:

In reference to the table assembly invented by Louis Schliemann and Jerome Borgos (U.S. Pat. No. 3,731,639), there are similarities in design (in each instance a unique base module is combined with like modules to form a supportive structure), as well as function, that being the use of interengaging (slotting) modules as a design mechanism. In the Schliemann Assembly the slotting mechanism is more like a hinge, the outer end sections of each module turning on their axis, the center of balance. In the present invention the slotting (interengaging) mechanism does not involve rotating or turning sections in the module, but rather one fixated construction for each module and one final construction position for the indicated number of interengaged modules.

In reference to the table assembly invented by E. J. Schwabe (U.S. Pat. No. 1,963,594), the components of the table base rotate on a central axis as in the base assembly of the Schliemann/Borgos table. Though both assemblies can be variable axially, the Schwabe Assembly is intentionally limited to less than the entire 360° rotation, because of the vertical extension of the four legs. The Schwabe assembly bears stronger resemblance to the present invention in that both attain the desired maximum support of their specific horizontal surfaces in final, fixated construction positions (see FIG. 2 of Schwabe U.S. Pat. No. 1,963,594, and FIGS. 1,8; 9,10; and 11,12 of the present invention).

BRIEF SUMMARY OF THE INVENTION

The present invention involves the use of the assembly module (see FIGS. 2 to 4), the primary structural unit which comprises a part of an entire sturdy base assembly. Assuming that materials of designated sufficient strength represent individual sections of the module (specifically five), the assemblies constructed from the modules range in use from a base for a table or stool to platform scaffolding or staging.

The specific assembly illustrated in FIGS. 1 to 8 involves twelve of these modules, the number so chosen to produce an aesthetically appealing symmetric pattern. This 3-dimensional stellar pattern in turn provides the geometric structure for the more basic variations of the overall structure, the triangular assembly (using three modules, as in FIGS. 9,10) and the square assembly (using four modules, as in FIGS. 11,12).

BRIEF DESCRIPTION OF THE VARIOUS VIEWS

Figure 5:
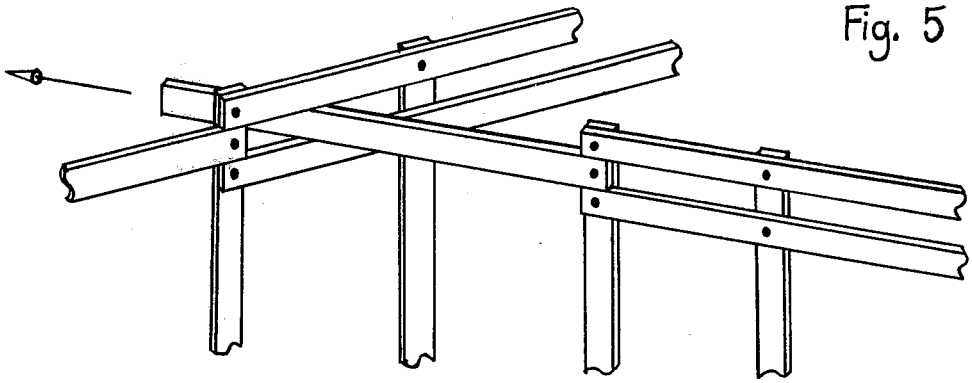
Figure 6:
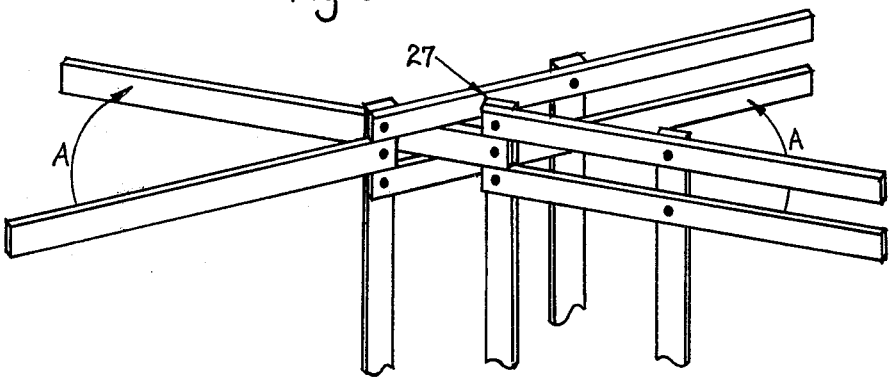

FIGS. 5,6 are perspective views of two base modules (in each view) demonstrating the slotting mechanism previously described. FIG. 5 shows the method of slotting two base modules; FIG. 6 shows the configuration of two base modules of an entire assembly in their most compact, slotted form.

Figure 7:
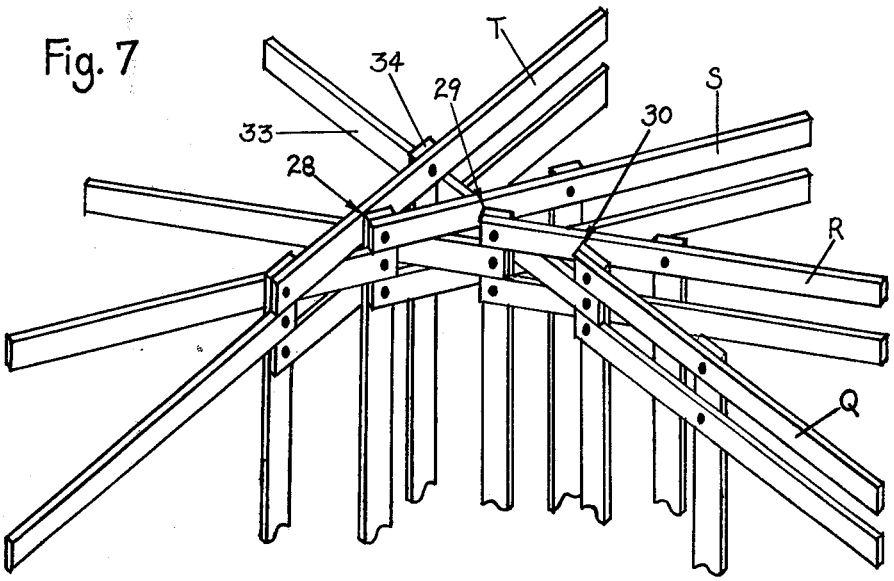

FIG. 7 is a perspective view showing four base modules of an entire assembly in their most compact, slotted form.

Figure 8:
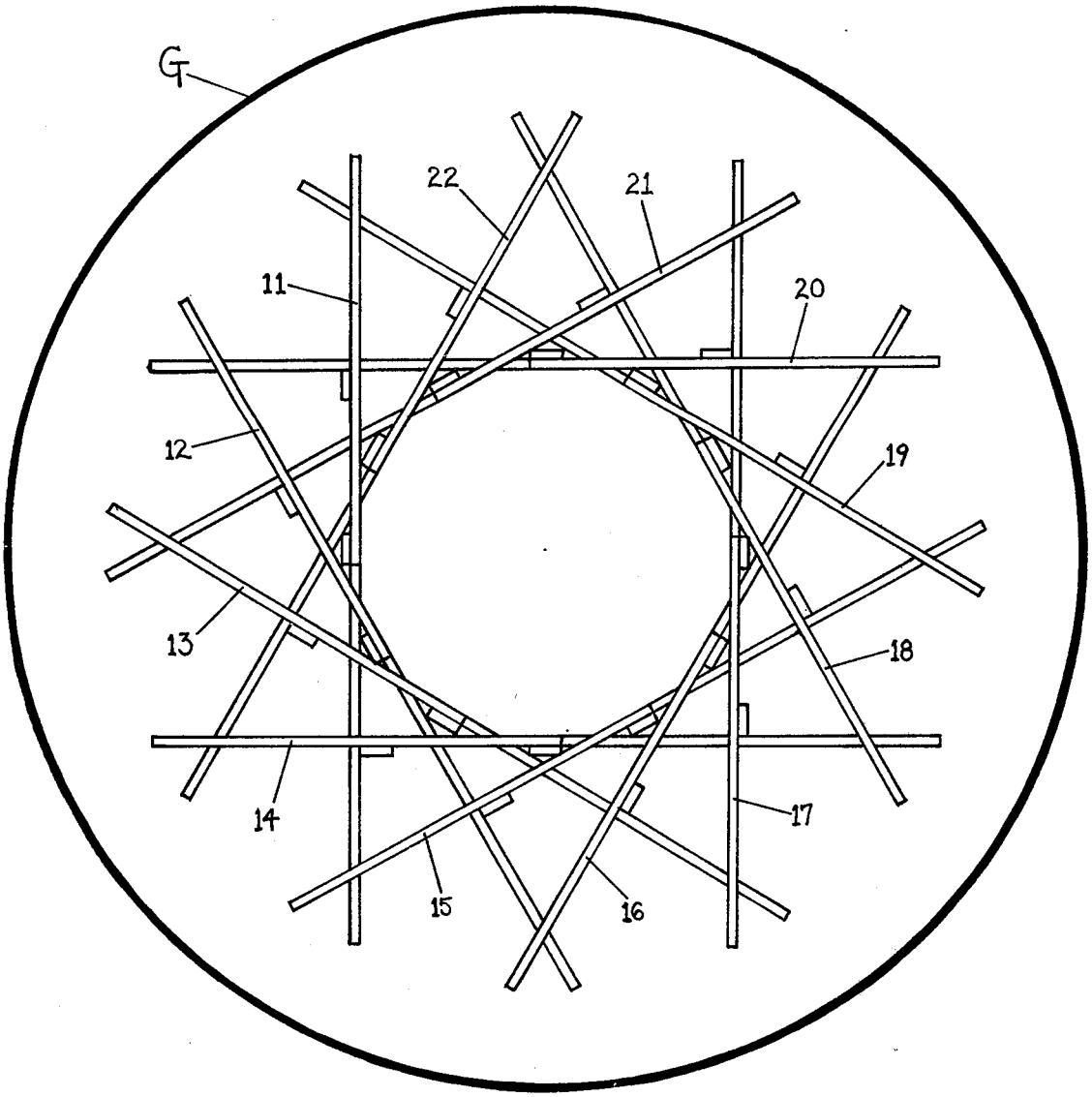

FIG. 8 is a plan view of the entire base assembly, circular clear table top included.

Figure 9:
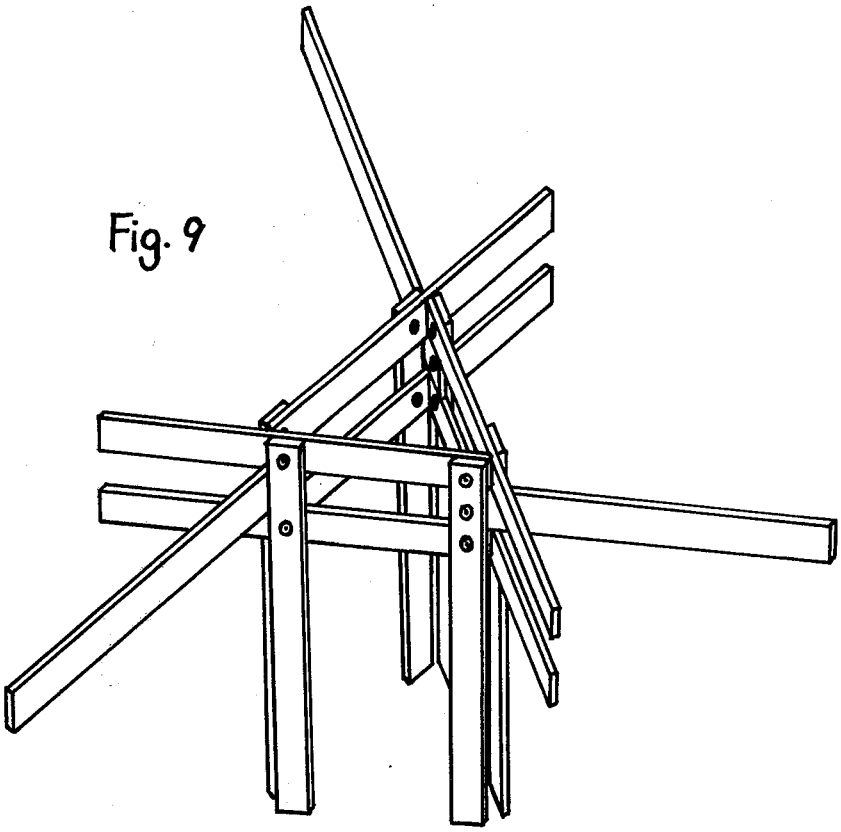

FIG. 9 is a perspective view of a triangular base assembly.

Figure 10:
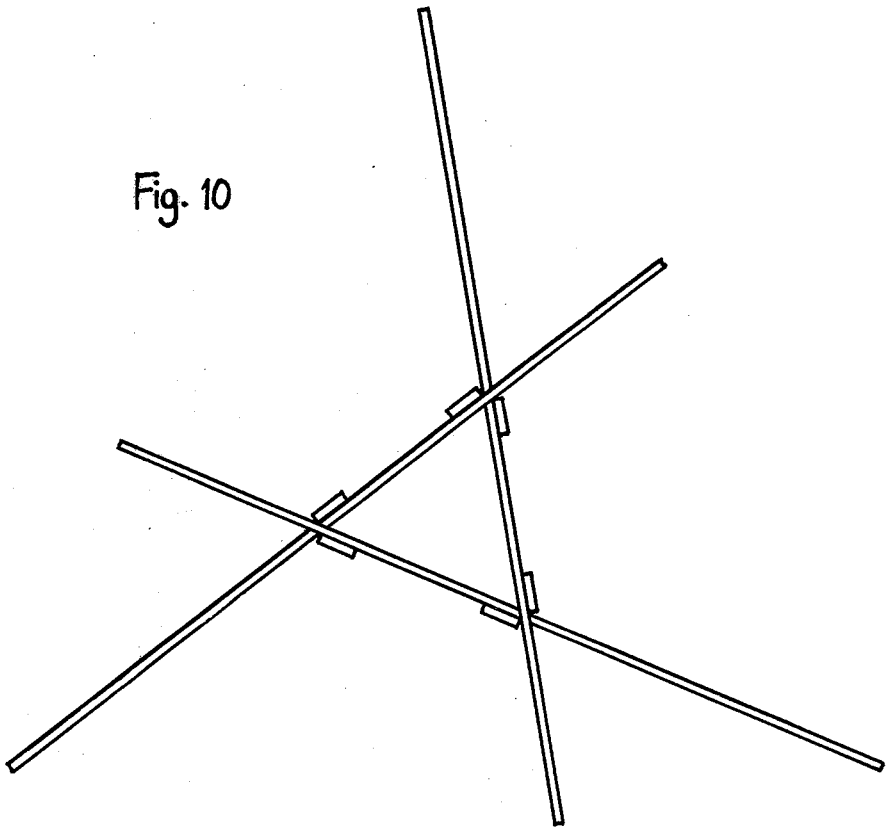

FIG. 10 is a plan view of a triangular base assembly.

FIG. 11 is a perspective view of a square base assembly.

FIG. 12 is a plan view of a square base assembly.

DETAILED DESCRIPTION OF THE INVENTION

Figure 1:
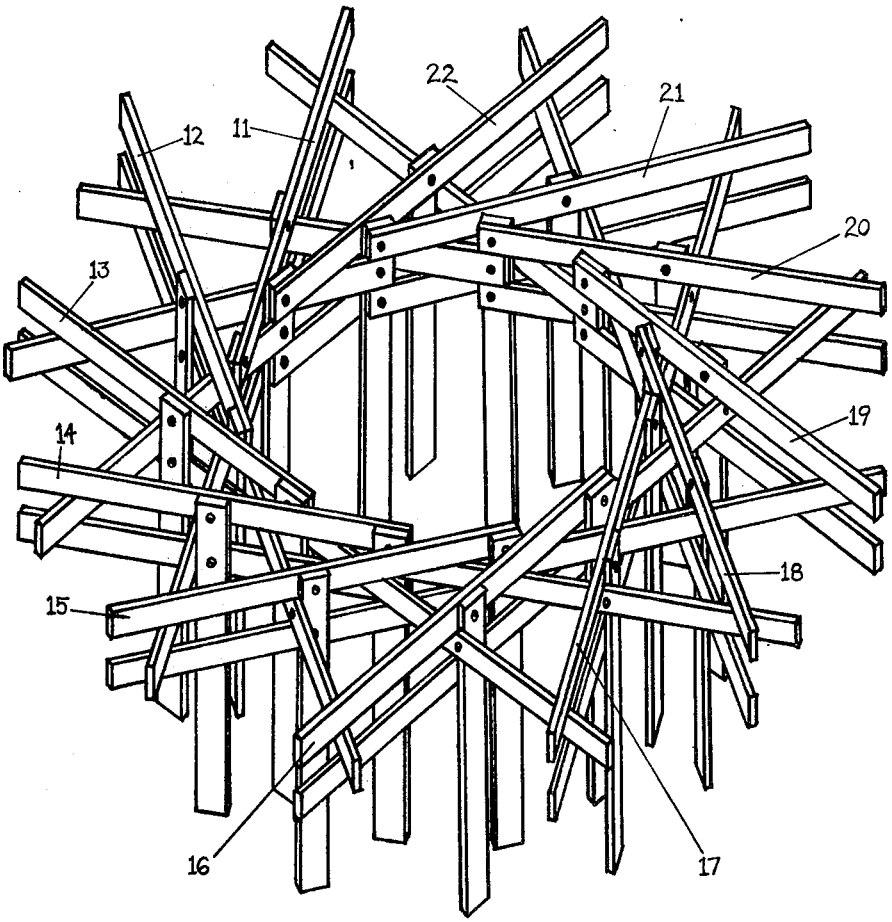
FIG. 1 is a perspective, 3-dimensional view of the entire twelve-module assembly.
Figure 2:
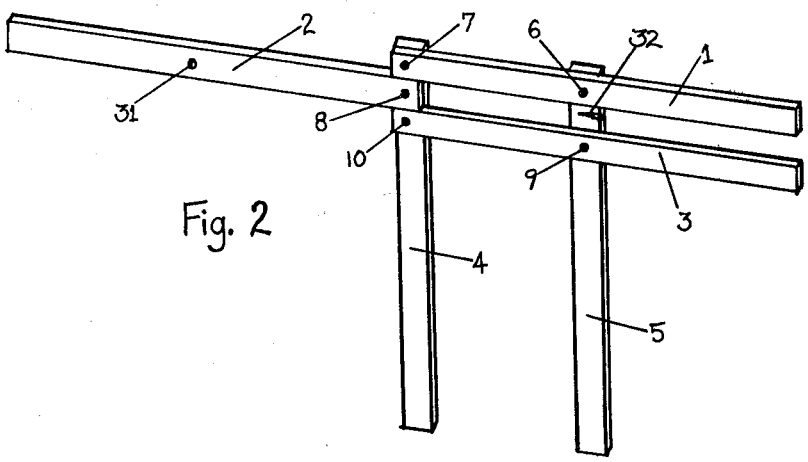
FIGS. 2,3 are perspective views of a single base module, FIG. 2 representing the frontal view, FIG. 3 representing the rear view.
Figure 3:
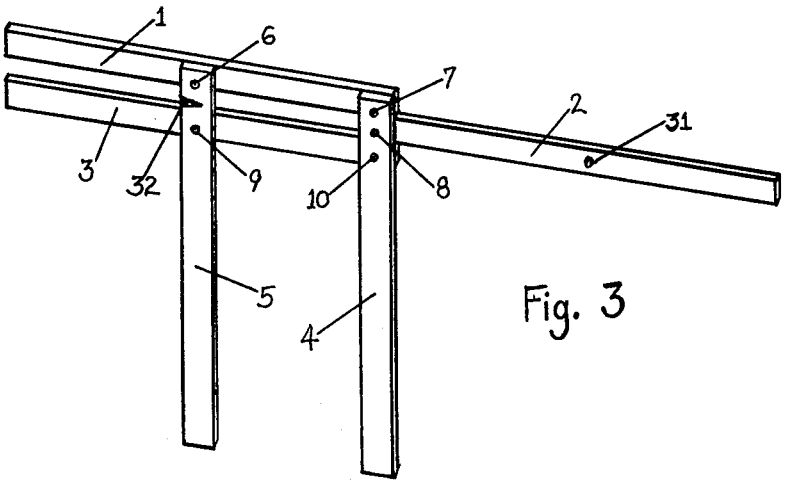
Figure 4:
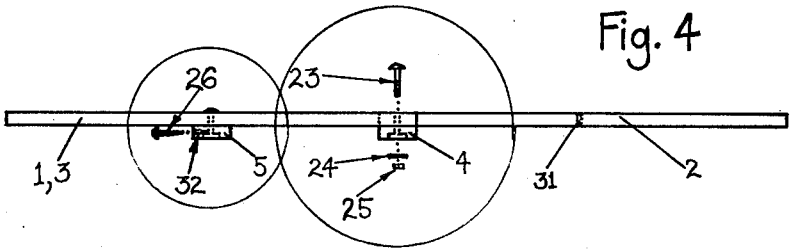
FIG. 4 is a plan view of a single base module with exploded views of the areas containing bolts and screws.

In reference to FIG. 1, there is shown an entire assembly constructed of twelve slotted base modules (individually illustrated in FIGS. 2,3 and 4). The assembly supports a horizontal surface on the lengthwise edges of the upper, horizontal boards of each of the 12 modules (11–22 in FIGS. 1 and 8, and 1 in FIGS. 2 to 4).

In order to understand how the invention is constructed, a detailed description of a single base module must be made. In reference to FIGS. 2 and 3, each module contains five identical boards 1-5, each measuring 1 inch by 3 inches by 30 inches (or 2½ feet). Held together by five identical sets of carriage bolt systems 6–10, two vertical boards 4,5 represent legs and three horizontal boards 1,2,3 represent the structural members of the horizontally supportive, circular stellar pattern. Referring now to FIG. 2 as the frontal view, the left end of the upper horizontal member 1 is bolted to the upper end of the main vertical leg 4. The right end of the middle horizontal member 2 is bolted to the main vertical leg 4 directly below and flush to the upper horizontal member 1. In the same cyclic manner, the left end of the lower horizontal member 3 is bolted to the main vertical leg 4 directly below and flush to the middle horizontal member 2. The edges of all three horizontal members are bolted flush to the vertical edge of the main vertical leg.

The second vertical leg 5 is bolted to the upper and lower horizontal members 1,3 10 inches from the main vertical leg 4 so that the horizontal members retain their already parallel rigidity (created by the three horizontal members bolted together flush to the main vertical leg). In other words, the upper and lower horizontal members 1,3 are bolted to the second vertical leg 5 so that they remain parallel, the space between them being created by the middle horizontal member 2 which extends on parallel lines to the opposite side of the main vertical leg 4.

In reference to FIG. 4, the plan view of a single base module (shown in perspective in FIG. 3), it is clear that the horizontal members 1,2,3 are bolted to the front plane of the vertical legs 4,5. In other words the carriage bolts 23 go through the horizontal members before anchoring into the legs. Therefore the smooth round bolt heads (which explains the preferance to carriage bolts) remain exposed in the frontal module design (see 6–10 in FIG. 2). The length of 1½ inches was chosen so the carriage bolts would remain flush with the backsides of the legs. For this reason, the flat washers 24 and hex nuts 25 are all countersunk, the diameter of the countersunk hole just slightly exceeding the diameter of the flat washer (approximately ¾ of an inch).

Hex nuts were chosen so the base assembly could be constructed with a hexagonal socket set.

FIGS. 5–7 demonstrate the slotting mechanisms previously claimed. In FIG. 5, the middle horizontal member of one module is inserted through the upper and lower horizontal members and between the two vertical legs of the second module.

FIG. 6 shows two of the twelve modules in their final, most compact, slotted form, the interior angles A being 30°(or 1/12 of the 360° circle). Since there are twelve modules (or 12 basic lines—see 11–22 in FIG. 8) in the entire assembly, the 360° circle is divided into 12 30° angles. In this final slotted position, the adjoining vertical edge of the main vertical leg of the right module abuts (makes contact with) the frontal face of the upper and lower horizontal members of the left module (the vertical lines designated by 27 in FIG. 6; 28,29,30 in FIG. 7).

In reference to FIG. 7, the middle horizontal member 33 of every module Q butts perpendicularly (at a 90° angle) against the right edge (assuming the frontal view) of the second vertical leg 34 and in between the upper and lower horizontal members of the third module T around the progression. In essence the middle horizontal member of every module butts flush at a right angle to the second leg of the third module in the progression to the left (in terms of a module series Q,R,S,T, module Q is perpendicular to module T, module R to module U, etc.).

It is at this junction that the support screws 26 (in FIG. 4) are used after completion of the final table assembly for greater support and strength of the entire structure. In reference again to FIGS. 2–4, the screws go through centered holes 31 in the middle horizontal member of every module and anchored into centered holes 32 in the edge of the second vertical leg of the appropriate perpendicular module. Round head sheet metal screws 26 (2 inches long × 12 guage) were chosen because their deep threads offer maximum strength and grip.

Although the entire base assembly involves 12 30° angles (see detailed description of FIG. 6), slight alterations in compactness and angle must be temporarily made on modules 19,20,21,22 (assuming that the upper horizontal members 11–22 here temporarily represent the modules containing them in FIGS. 1,8) in order to be able to slot the last module 22 into the first module 11. If modules 19–22 are loosely slotted with each other and their previous modules, then the alteration in angle can be made to complete the entire assembly. The final step of the slotting system is to compact the overall structure to its final base assembly configuration (FIGS. 1,8), involving twelve 30° angles.

As noted in the Brief Invention Summary, it is apparent how the three- and four-module variations are derived directly from the geometric structure of the entire base assembly. The triangular assembly (FIGS. 9,10) is composed of three base modules (FIGS. 2–4) compacted into an equilateral structure. The square assembly (FIGS. 11,12) is composed of four of the original twelve base modules. As was the case in the triangular assembly, the square assembly retains the planar, geometric structure of the entire assembly, but here the four modules are compacted to retain their particular planar structure (in reference to the square assembly, a parallel and perpendicular planes). Though much more basic structurally, both the triangular and square base assemblies provide durable, sturdy support for a horizontal surface.

I claim:

1. An article of manufacture comprising a base composed of interengaging modular units, each of said modular units comprising a pair of spaced vertical supporting members, a pair of spaced horizontal members attached to said vertical members at the upper ends thereof, thereby forming a slot therebetween, an additional horizontal member to fit such slot attached to a vertical member at a point between the said pair of horizontal members and extending in a direction opposite that of the pair of slot forming members, all of the members of each of the modular units being in the same vertical plane, said additional horizontal member engaging the slot of an adjacent modular unit, thereby forming a three dimensional supporting structure.

2. An article of manufacture as defined in claim 1 wherein the number of said modular units is at least three, and the top edge of the upper member of the pair of horizontal members are in the same horizontal plane, thereby forming a support for a flat horizontal surface, such as a table top.

3. An article of manufacture as defined in claim 2, wherein the number of modular units is 12 and said modular units support a cirular horizontal surface to form a circular table.

* * * * *